United States Patent [19]

Schindler

[11] Patent Number: 5,076,437

[45] Date of Patent: Dec. 31, 1991

[54] PIZZA STORAGE CONTAINER

[76] Inventor: Philip Y. Schindler, 10491 N.W. 20th Ct., Sunrise, Fla. 33322

[21] Appl. No.: 597,013

[22] Filed: Oct. 15, 1990

[51] Int. Cl.[5] ..... A45C 11/20

[52] U.S. Cl. ..... 206/551; 206/508; 206/509; 220/503; 220/504; 220/523; 220/529; 220/554; 220/375; 220/DIG. 13

[58] Field of Search ..... 206/551, 561, 508, 509, 206/511; 220/375, 337, 339, 503, 504, 523, 524, 526, 554, 553, 556, 529, DIG. 13

[56] References Cited

U.S. PATENT DOCUMENTS

| | | | |
|---|---|---|---|
| D. 161,771 | 1/1951 | Lumley | 220/554 |
| 249,167 | 11/1881 | French | 220/DIG. 13 |
| 585,099 | 6/1987 | Helbach | 220/554 |
| 1,880,250 | 10/1932 | Hopkins | 220/524 |
| 2,388,442 | 11/1945 | Reyburn | 206/551 |
| 2,452,969 | 11/1948 | Victor | 206/551 |
| 2,525,337 | 10/1950 | Brooks et al. | 206/551 |
| 2,602,540 | 7/1952 | Hurst | 206/551 |
| 2,727,547 | 12/1955 | Moon, III | 220/375 |
| 3,238,004 | 3/1966 | Goebel | 220/529 |
| 4,040,539 | 8/1977 | Patterson | 220/526 |
| 4,273,249 | 6/1981 | Florian | 220/339 |
| 4,286,713 | 9/1981 | Marchais | 206/508 |
| 4,492,333 | 1/1985 | Roberts | 206/551 |
| 4,552,272 | 11/1985 | Field | 220/529 |
| 4,733,794 | 3/1988 | Kent | 220/339 |
| 4,754,895 | 7/1988 | Lardner et al. | 220/375 |
| 4,811,846 | 3/1989 | Bottega | 206/551 |
| 4,947,993 | 8/1990 | Bruml et al. | 206/551 |
| 4,971,220 | 11/1990 | Kaufuran et al. | 220/339 |

FOREIGN PATENT DOCUMENTS

| | | | |
|---|---|---|---|
| 652370 | 11/1985 | Switzerland | 206/55 |

*Primary Examiner*—David T. Fidei

*Attorney, Agent, or Firm*—Malloy, Downey & Malloy

[57] ABSTRACT

A container for storing slices of pizza therein, comprising a main container housing having an interior storage compartment structured and configured to conform with the shape of a standard slice of pizza. The container housing includes an open end adapted to receive at least one slice of pizza therethrough for containment within the storage compartment. A removable cap is structured to fit over the open end in covering, sealed relation to the storage compartment and is secured thereto by protruding knobs on the cap which snap into slots formed in opposite sides of the container housing. A surrounding outer lip formed on the upper peripheral edge of the container facilitates vertical stacking of several containers.

7 Claims, 1 Drawing Sheet

PIZZA STORAGE CONTAINER

BACKGROUND OF THE INVENTION

1. Field of the Invention

A storage container for storing slices of pizza therein.

2. Description of the Prior Art

The container art is crowded with numerous types of containers adapted to store various types of food substances therein for keeping the food fresh for a prolonged period of time. Usually, these containers are stored within a refrigerator wherein the cold environment in combination with the sealed container acts to further prolong the freshness of the food to be eaten by the user at a later time. Commonly, it is desirous by many people to save food which is left over from a meal by placing in these containers to be stored in the refrigerator.

Most of the storage containers for storing leftover food comprise a square or rectangular configuration having a base portion which usually has a substantially deep storage compartment therein and a lid which is adapted to be fitted in covering relation to an open top of the base portion. Accordingly, leftover food such as vegetables, meat, fish and the like can be placed within the container and with the lid placed thereon, the containers are stored in the refrigerator thereby saving the food for later consumption over the next several days.

There are some types of food which, because of the nature of their dimensions and physical characteristics, are not suitable for placement in the standard storage containers as commonly known in the prior art. One such food type is pizza which normally consists of individual slices making up a whole pie. Because pizza is usually purchased in units as a whole pie consisting of usually eight to twelve slices, it is not uncommon that at least one, and sometimes several slices of the pizza are left over after a meal. In an attempt to save these individuals slices so that they can be eaten the next day, most people wrap the slices in aluminum foil or cellophane wrap and place them in the refrigerator. In doing so, the foil or cellophane tends to adhere to the cheese and other toppings on the slice of pizza so that when the wrapping is later removed, the cheese and toppings are peeled off from the rest of the pizza slice. Additionally, when food such as pizza is wrapped in aluminum foil, the contents within the wrapped package are not readily apparent to a person searching through the refrigerator the next day and often, these wrapped aluminum packages are ignored to the point where the food therein spoils and becomes inedible.

It is undesirable to place slices of pizza in the commonly known square and rectangular containers known in the prior art for several reasons. First, the shape of the pizza slice often does not correspond with the shape of the container and therefore, it is necessary to bend or deform the slice so as to fit it within the storage compartment of the container. Additionally, it is not desirous to stack slices on top of one another because of the problem of a cheese and other topping sticking to the bottom of the stacked slice when removing them from the container. Another problem associated with the containers of the prior art is that the storage compartments are often substantially deep and therefore, a single slice stored therein is still exposed to a substantial amount of air even with the lid placed in sealed connection on the container opening.

Accordingly, there is a need in the present container art for a pizza container adapted for the storage of slices of pizza within a storage compartment wherein the containers is specifically structured and configured so as to conform with the shape of the slice of pizza thereby facilitating easy placement and removal of the pizza slice in and out of the container. Additionally, there is need in the present container art for a pizza container adapted to receive several slices of pizza individually wherein the slices can be stored within the storage compartment of the container without the need for stacking them upon one another.

SUMMARY OF THE INVENTION

The present invention is directed to a storage container for storing slices of pizza. The storage container includes a container housing which, in a preferred embodiment, conforms to the overall shape of an individual slice of pizza. The container housing includes a top portion and a bottom portion as well as a side wall portion and an open end. The open end is formed and configured for slidable receipt of at least one slice of pizza therethrough for containment within an interior storage compartment in the container housing. The interior dimensions of the interior storage compartment are slightly larger than and generally have the same overall configuration as a slice of pizza so that a slice can be inserted and removed from the container without the cheese or other topping sticking to the container.

A removable cap is structured and configured so as to fit in covering, sealed relation over the open end of the container housing so as to enclose and seal off the interior storage compartment thereby preserving the freshness of any slices of pizza stored therein. Securing means are provided to secure the cap in fixed, sealed position on the container housing. In the preferred embodiment, the securing means include a pair of elongate, protruding knob portions formed on an inner surface of the removable cap being specifically structured to snap-fit in securing relation within a pair of elongate slots formed on opposite sides of the container in close, spaced relation to the open end. Accordingly, the removable cover can be slid over the open end with an inner surface of the cap slidably engaging with an outer surface of the container housing until the protruding knobs engage within the elongated slots thereby securing the cap in sealed, fixed position on the container housing.

Additionally, the interior storage compartment may have at least one shelf fitted therein extending horizontally across the width of the compartment and connecting the side wall portion in spaced parallel relation to the top and bottom portions so as to divide the storage compartment into separate levels. In this manner, several slices of pizza, depending upon the number of shelves in the storage compartment, can be stored within the container by sliding them through the open end and into the various segregated levels.

Another feature of the present invention is an outer lip formed on the upper peripheral edge of the container extending about the peripheral edge of both the top portion of the container housing and the top edge of the removable cap so as to form a continuous lip thereabout specifically configured and disposed so as to facilitate stacking of an additional container thereon. Accordingly, several containers can be stacked vertically for efficient storage within a refrigerator or other confined space wherein the containers are substantially fixed in place relative to one another so as to prevent sliding or falling of the stacked array of containers.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
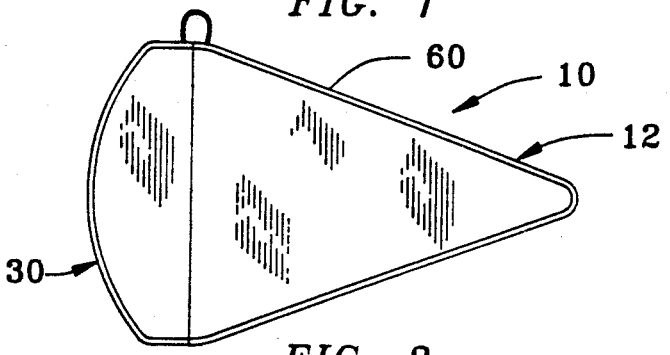
FIG. 1 is a top plan view of a preferred embodiment of the storage container of the present invention.
Figure 2:
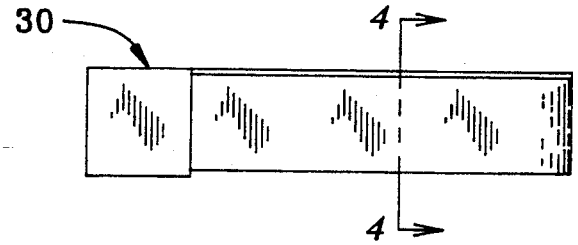
FIG. 2 is a side plan view of the storage container of FIG. 1.
Figure 3:
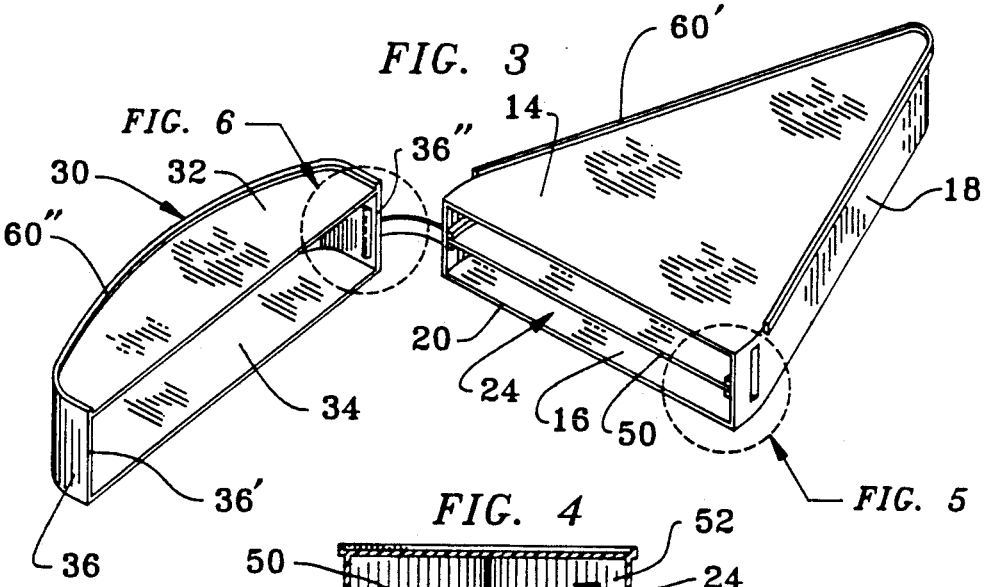
FIG. 3 is a perspective view of the preferred embodiment of the storage container as shown in FIG. 1 illustrating the separation of a removable cap from a container housing.

As shown in FIGS. 1 through 3, the present invention is directed towards a pizza storage container generally indicated as 10 for containing individual slices of pizza within a container housing 12 for fresh keeping. As best shown in FIG. 3, the container housing 12 includes a top portion 14, a bottom portion 16 and a surrounding side wall 18. Additionally, the container housing 14 includes an open end 20 having a sufficient width and being generally dimensioned and configured to slidably receive at least one slice of pizza therethrough.

An interior storage compartment generally indicated as 24 is disposed within the container housing 12 and is surrounded by the top portion 14, bottom portion 16 and side wall portion 18. The interior storage compartment 24 is configured so as to conform with the overall dimensions of a slice of pizza. Additionally, the overall dimensions of the interior storage compartment are preferably slightly larger than the overall outer dimensions of a standard slice of pizza to be stored therein such that the inner surface of the top portion 14 and inner surface of the side wall portion 18 do not interfere with the cheese or other topping on the pizza slice. Accordingly, a slice of pizza can be stored within the interior storage compartment 24 without the need for bending, folding or in any way deforming the overall shape of the slice.

As shown in FIG. 1 through 3, the pizza container of the present invention includes a removable cap 30 adapted to be positioned in covering, sealing relation to the open end 20 so as to effectively close off and seal the interior storage compartment 24 thereby preserving the freshness of any slices of pizza stored therein. The removable cap 30 includes an upper cover portion 32, a lower cover portion 34 and an end wall 36 connecting between the upper and lower cover portions and extending partially therearound terminating at opposite ends 36′ and 36″ at an open portion of the cap. Accordingly, the removable cap 30 is specifically designed to be slidably fitted over the open end 20 of the container housing 12 with an inner surface of the upper and lower cover portions 32 and 34 engaging with an outer surface of the top portion 14 and bottom portion 16 of the container housing. A hinge 37 is provided to allow removal of the cap 30 from the container while maintaining attachment thereto so as to prevent the cap 30 from being misplaced or lost. The hinge 37 is preferably formed of a substantially flexible material and comprises an elongate strip connecting at opposite ends between the cap 30 and the container housing 12. Additionally, an inner surface of the end wall 36 of the removable cap 30 near the opposite ends 36′ and 36″ engage with an outer surface of the surrounding side wall portion 18 of the container housing 12 thereby effectively sealing off the interior storage compartment 34 so as to preserve the freshness of slices of pizza stored therein.

Figure 5:
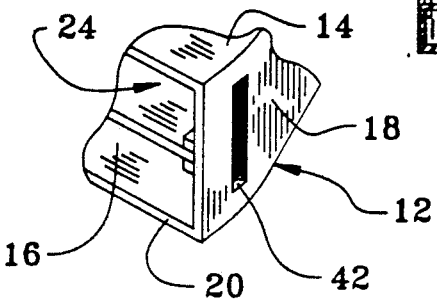
FIG. 5 is a cutaway view taken from the container housing in FIG. 3 as indicated by the arrow and broken line.
Figure 6:
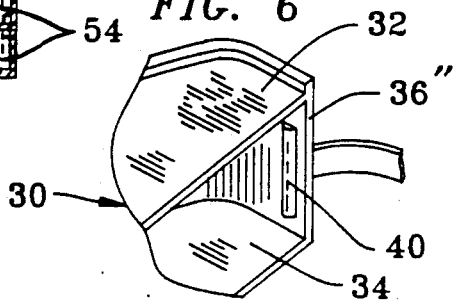
FIG. 6 is a cutaway view taken from the cap in FIG. 3 as indicated by the arrow and broken line.

Securing means are provided to secure the removable cap 30 in covered, fixed sealed relation over the open end 20 of the container housing 12. As best illustrated in FIGS. 5 and 6, the securing means in the preferred embodiment of the present invention include a pair of elongate, protruding knobs such as 40 formed on the inner surface of the removable cap 30 in close space relation to the opposite ends 36′ and 36″. Each of the protruding knobs 40 has a semi-cylindrical outer configuration adapted to slidably snap-fit in place into an elongated slot 42 formed on opposite sides of the container housing 12 on the side wall portion in close, spaced relation to the open end 20.

Figure 4:
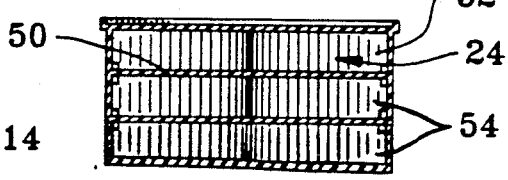
FIG. 4 is a further embodiment, illustrating a plurality of shelves fitted within the interior storage compartment, in a sectional view taken along the line 4—4 of FIG. 2.

An additional feature in the preferred embodiment of the present invention is a removable interior shelf 50 removably positioned within the interior storage compartment 24 and extending across and fitted within receiving tracks 51 formed along an inner surface of the side wall portion 18 so as to position the shelf in spaced parallel relation to the top portion 14 and bottom portion 16. The interior shelf 50 effectively divides the interior storage compartment 24 into two levels 52 and 54, as best seen in FIG. 4. Accordingly, two slices of pizza can be stored within the container housing 12, one in the upper storage level 52 and the other in the lower storage level 54 in segregated relation so that they do not interfere with the cheese or other topping on the pizza. It should be noted that several interior shelves 50 can be removably positioned within a somewhat higher interior storage compartment 24 thereby providing additional levels for storage of numerous slices of pizza within the container in segregated, undisturbed relation.

The preferred embodiment of the present invention further includes a surrounding outer lip 60 formed on the upper peripheral edge of the container including a first lip portion 60′ on the outer peripheral edge of the top portion 14 of the container 12 as well as a second lip portion 60″ formed on the outer peripheral edge of the upper cover portion 32 of the removable cap 30. When the removable cap 30 is placed in covering relation on the open end 20 of the container housing 12, the opposite ends of the first lip portion 60′ meet with the opposite ends of the second lip portion 60″ on the cap so as to form one continuous, surrounding peripheral lip 60 on the top of the storage container 10. The surrounding lip 60 is specifically configured and disposed so as to facilitate stacking of several of the pizza storage containers 10, one upon the other in substantially fixed non-sliding relation thereby preventing sliding or falling of the containers when in a stacked array.

Now that is invention has been described,

What is claimed is:

1. A container for storing slices of pizza therein, said container comprising:

a main container housing including a top portion, a bottom portion, a side wall portion, and an open end disposed in surrounding relation to a hollow interior storage compartment, a removable cap structured and configured to fit in covering, sealing relation over said open end of said container housing so as to enclose said interior storage compartment, said removable cap including an upper cover portion, a lower cover portion, and a partially surrounding end wall having a curvilinear configuration adapted to conform with the shape of a crust portion of a slice of pizza stored within said interior storage compartment, securing means for securing said removable end cap to said container housing, said container housing and said interior storage compartment being formed and configured so as to conform with the shape of the slice of pizza stored therein, said open end being structured and configured for slidable receipt of at least one slice of pizza therethrough for containment and storage within said interior storage compartment, and stacking means including an outer peripheral lip extending about an upper peripheral edge of said container and including a first lip portion disposed about a peripheral edge of said top portion of said container housing and a second lip portion disposed about a peripheral edge of said upper cover portion of said removable cap, said outer peripheral lip being structured and disposed so as to facilitate stacking of a plurality of containers, wherein said bottom portion and said lower cover portion of an upper positioned container is supported within the outer peripheral lip of a lower positioned container.

2. A container as in claim 1 wherein said removable cap is connected to said container housing by an elongate, substantially flexible strip defining a hinge member whereby said removable cap remains connected to said container housing when removed from said open end.

3. A container as in claim 2 wherein said securing means includes a pair of elongate, protruding knobs formed on an inner surface of said end wall of said cap at opposite ends thereof, each of said protruding knobs being structured so as to snap-fit within one of two oppositely disposed slots formed in said side wall portion in close, spaced relation to said open end on opposite sides of the container housing.

4. A container as in claim 1 further including a shelf fitted within said interior storage compartment and disposed in spaced parallel relation to said top portion and to said bottom portion so as to divide said storage compartment into two segregated levels wherein two slices of pizza can be stored therein.

5. A container as in claim 4 wherein said shelf is removably fitted within said interior storage compartment being slidably receivable with a receiving track formed about an inner surface of said side wall portion of said container housing.

6. A container as in claim 5 wherein a plurality of shelves are fitted within said interior storage compartment so as to form a plurality of storage levels wherein a plurality of slices of pizza can be separately stored within the container.

7. A container as in claim 1 wherein the container housing is formed and configured to accommodate storage of at least two slices of pizza in adjacent relation to one another on a single storage level.

* * * * *